US006651630B2

(12) United States Patent
Hiraku et al.

(10) Patent No.: US 6,651,630 B2
(45) Date of Patent: Nov. 25, 2003

(54) HIGH PRESSURE FUEL PUMP

(75) Inventors: Kenji Hiraku, Chiyoda (JP); Kenichiro Tokuo, Chiyoda (JP); Yuzo Kadomukai, Ishioka (JP); Kunihiko Takao, Tsuchiura (JP); Hiroyuki Yamada, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/247,302

(22) Filed: Sep. 20, 2002

(65) Prior Publication Data

US 2003/0059322 A1 Mar. 27, 2003

(30) Foreign Application Priority Data

Sep. 21, 2001 (JP) ..... 2001-287992
Nov. 15, 2001 (JP) ..... 2001-349553

(51) Int. Cl.[7] ..... F02M 37/04

(52) U.S. Cl. ..... 123/506; 251/129.02; 417/490; 417/505; 123/458

(58) Field of Search ..... 123/456, 506, 123/458, 446; 417/490, 503, 505, 510, 571, 440; 251/129.02, 129.15, 129.16, 129.17

(56) References Cited

U.S. PATENT DOCUMENTS 4,550,744 A * 11/1985 Igashira et al. ..... 137/80
5,503,364 A * 4/1996 Enomoto et al. ..... 251/129.02
6,045,120 A * 4/2000 Tarr et al. ..... 251/282
6,116,870 A * 9/2000 Kraemer ..... 417/490
6,192,864 B1 * 2/2001 Nishimura ..... 123/458
6,345,608 B1 * 2/2002 Rembold et al. ..... 123/506
6,447,273 B1 * 9/2002 Nishimura et al. ..... 417/505
6,505,608 B2 * 1/2003 Hiraku et al. ..... 123/458
6,546,918 B2 * 4/2003 Onishi et al. ..... 123/506
6,554,590 B2 * 4/2003 Maeda et al. ..... 417/505

FOREIGN PATENT DOCUMENTS

JP WO 00/47888 8/2000

* cited by examiner

*Primary Examiner*—Carl S. Miller
(74) *Attorney, Agent, or Firm*—Antonelli, Terry, Stout & Kraus, LLP

(57) ABSTRACT

In order to provide a method for high volume and high pressure operation of a variable delivery type single cylinder plunger pump, the displacement of the piezoelectric element 20 is magnified by a hydraulic displacement magnifying mechanism comprising a large-diameter bellows 204, a small diameter bellows 202 and working fluid 208, and an engaging member 201 is displaced to control the time interval of opening and closing the intake valve 5. The large-diameter bellows 204 is used at all times in the state compressed in the direction of displacement transfer, thereby ensuring that the pressure of the working fluid 208 is maintained at a positive value to prevent vapor from being generated. The thermal expansion of a casing 23 is selected in such a way that the total thermal expansion of the piezoelectric element 200 and hydraulic displacement magnifying mechanism in the direction of displacement transfer is approximately the same as the thermal expansion of the casing 23, whereby highly efficient driving is provided.

10 Claims, 9 Drawing Sheets

HIGH PRESSURE FUEL PUMP

BACKGROUND OF THE ONVENTION

The present invention relates to a high pressure fuel pump for providing a high pressure supply of fuel to the fuel injection valve of the engine.

A high pressure fuel pump for a car engine known in the prior art is a variable delivery type fuel pump wherein a solenoid is used to control the time of opening or closing an intake valve and the amount of fuel to be delivered is variably adjusted. An example is found in an apparatus disclosed in the specification of the International Publication Number WO00/47888.

The aforementioned example will be described below: When the solenoid is turned off, an intake valve is pushed open by an engaging member provided with energizing force by a spring, and is kept open So that the solenoid turned on. This generates force greater in the direction reverse to the aforementioned energizing force, wherein this generated force is greater than the aforementioned energizing force. In this manner, the intake valve is closed. This step controls the intake valve opening/closing time interval, whereby the amount of delivery is controlled, according to said prior art.

PROBLEMS TO BE SOLVED BY THE INVENTION

However, when the aforementioned prior art high pressure fuel pump is used, the intake valve is forcibly closed by the pressure of the fuel flowing backward of the intake valve, even if an attempt is made by the engaging member to keep the intake valve open in the delivery stroke of the pump in the case of a high flow rate as in high-speed rotation. Thus, over a certain rotational speed, control of the amount of delivery is difficult in this type of prior art pump. This problem can be solved by increasing the force of a spring for energizing the engaging member. However, depending on the size, the solenoid is limited in the capacity to generate force. So a small solenoid cannot lift the engaging member, and the amount of delivery cannot be controlled in the case of a compact configuration. Further, when the pump displacement volume is to be increased, there is a further increase in the flow rate in passing through the intake valve, with the result that the rotation speed at which the amount of delivery can be controlled is further reduced. An actual car is required to provide a large-volume fuel pump with a high degree of displacement.

Further, a high speed type engine and multiple cylinder engine such as V8 and V10 is required to contain a solenoid capable of providing a high degree of response. However, the aforementioned prior art high pressure fuel pump has failed to give a sufficient consideration to ensure a highly responsive solenoid. In a single cylinder plunger type which is a current mainstream of the high pressure fuel pump, the number of plunger reciprocating motions must be increased in proportion to the number of engine cylinders in order to be synchronized with the fuel injection valve, because this reduces the control cycle.

SUMMARY OF THE INVENTION

The object of the present invention is to provide a variable delivery type high pressure fuel pump, which permits the amount of delivery to be controlled even in the case of a high flow rate, and which can be mounted on a high speed engine and a multiple cylinder engine to ensure that the amount of delivery is controlled at a high degree of response.

The high pressure fuel pump according to the present invention is a variable delivery type high pressure fuel pump comprising;

A variable delivery type high pressure fuel pump comprising:

a pressure chamber leading to a fuel intake passage and a delivery passage;

a plunger that makes a reciprocating motion in said pressure chamber;

an intake valve inserted in said intake passage;

a delivery valve inserted in said delivery passage; and an engaging member driven by said actuator so as to give an energizing force to said intake valve; wherein the time interval of opening and closing said intake valve is controlled by an actuator operated by external force;

said high pressure fuel pump characterized by further comprising a hydraulic pressure mechanism for holding said intake valve opened with said engaging member according to no input to said actuator.

Preferably the aforementioned high pressure fuel pump is characterized by further comprising a hydraulic displacement magnifying mechanism for magnifying said actuator displacement; wherein said hydraulic displacement magnifying mechanism gives energizing force to said intake valve.

More preferably, the aforementioned high pressure fuel pump is characterized in that this pump comprises a casing for storing the aforementioned actuator and hydraulic displacement magnifying mechanism, and the thermal expansion of this casing is selected in such a way that the total thermal expansion of the actuator and hydraulic displacement magnifying mechanism in the direction of displacement transfer is approximately the same as the thermal expansion of the aforementioned casing.

More preferably, the aforementioned high pressure fuel pump is characterized in that;

The aforementioned hydraulic displacement magnifying mechanism is configured to convert a small displacement of a large-diameter bellows into a large displacement of a small diameter bellows through working fluid enclosed in bellows; and the aforementioned large-diameter bellows is used at all times as it is compressed in the direction of displacement transfer with respect to the state of free length under no-load conditions in order to ensure that the pressure of this working fluid works at a positive value maintained at all times.

In another embodiment of the high pressure fuel pump according to the present invention, the aforementioned actuator is made of a piezoelectric element, electrostrictive element or magnetostrictive element. The aforementioned engaging member is configured to push to open the intake valve if there is no input to the actuator. Upon entry of an input to the aforementioned actuator, the actuator pulls the large-diameter bellows to pull in the engaging member that displaces integrally with the small diameter bellows, and releases engagement with the intake valve so that the intake valve can be closed.

Still more preferably, the aforementioned high pressure fuel pump is characterized by input voltage control method in such a way that;

after the input voltage given to the aforementioned actuator has been turned on, the actuator is kept turned on while the pressure in the pressure chamber remains as high as the pressure on the downstream side of the delivery passage; and, after the plunger has started intake stroke and the pressure in the pressure chamber has started to decrease, input voltage is reduced to move the engaging member close to the intake valve, and the engaging member is engaged with the intake valve by the time the intake valve starts to open, whereby the intake valve is energized in the direction of opening the valve.

DETAILED DESCRIPTION OF THE PREFERRED EMBODIMENT

Figure 1:
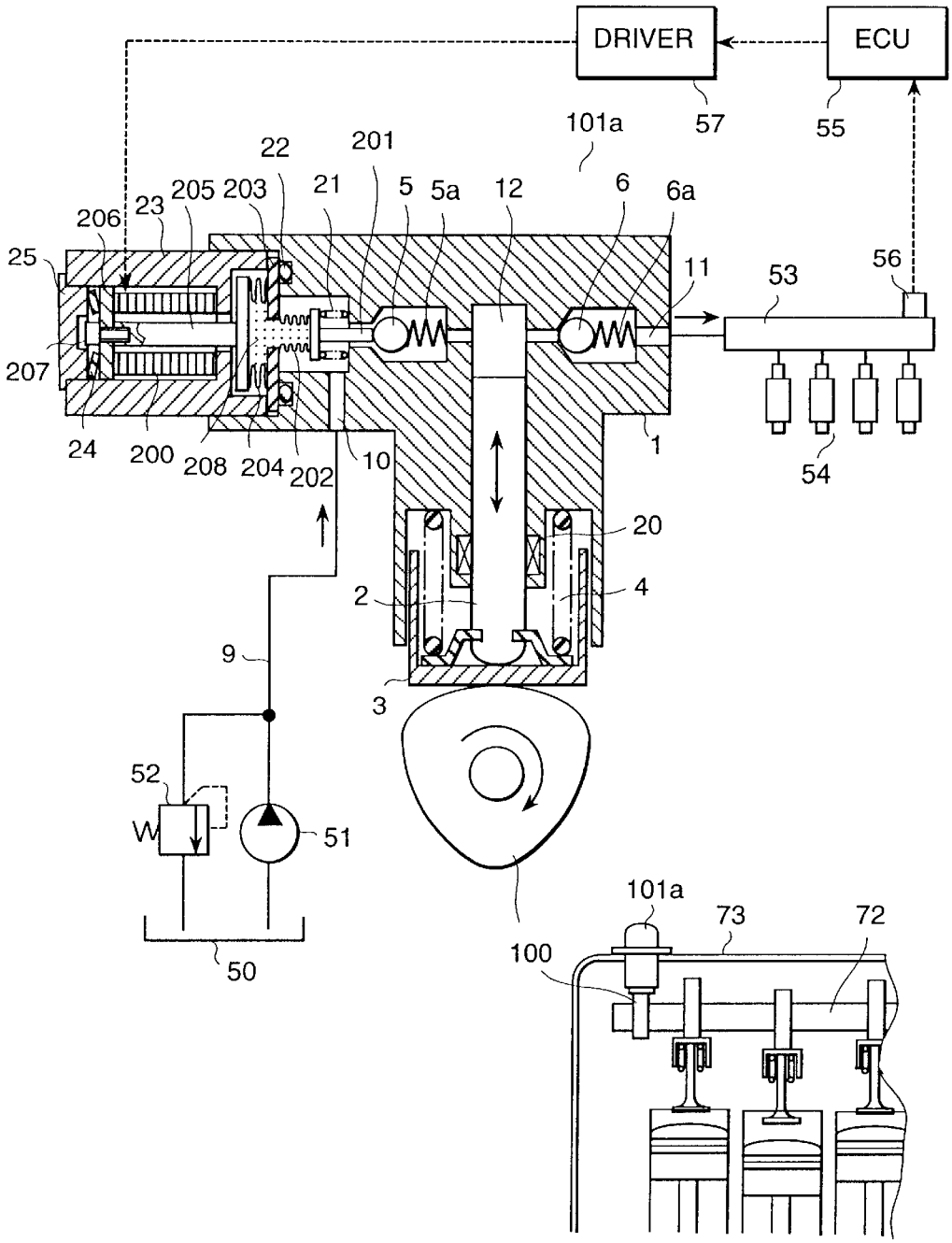
FIG. 1 is a vertical cross sectional view representing a high pressure fuel pump as an embodiment of the present invention.

The following describes the embodiments of the present invention with reference to drawings:

The following describes the configuration and operation of one embodiment of the present invention with reference to FIG. 1: A fuel intake passage 10, a delivery passage 11 and a pressure chamber 12 are formed on a pump body 1. A plunger 2 as a pressure member is slidably formed in the pressure chamber 12. An intake valve 5 and delivery valve 6 are provided in an intake passage 10 and delivery passage 11, and each of them is held in one direction by a spring, thereby serving as a check valve for restricting the direction of fuel flow. Further, a piezoelectric element 200 having a hollow cross section is held by the pump body, and the piezoelectric element 200 is arranged in such a way as to expand and contract a large-diameter bellows 204 through displacement transfer members 205, 206 and 207. The piezoelectric element 200 and displacement transfer member 206 are pressed and held by a belleville spring 24. The very small displacement of the large-diameter bellows 204 is converted into the large displacement of the small diameter bellows 202 through working fluid 208. An engaging member 201 and a spring 21 are arranged at the tip of this small diameter bellows 202. When the piezoelectric element 200 is off, the engaging member 201 is positioned so that the intake valve 5 is opened. To counter the total of the energizing force of the spring 5*a* and intake valve 5 and the energizing force of the spring 21, the fluid pressure of the working fluid 208 rises according to the Pascal's principle. So when the piezoelectric element 200 is off, the intake valve 5 is kept open, as shown in FIG. 1.

The piezoelectric element 200 has the advantage over the solenoid used in the prior art high pressure fuel pump that power output and response are much higher, but has the disadvantage that the amount of displacement is smaller. To solve this problem and to compensate for a very small amount of displacement of the piezoelectric element, the high pressure fuel pump of the present invention utilizes a hydraulic displacement magnifying mechanism comprising large-diameter and small diameter bellows, and working fluid enclosed therein.

Fuel is then led from a tank 50 to the fuel inlet of the pump body 1 by a low pressure pump 51 after having been regulated to a predetermined pressure by a pressure regulator 52. Then it is pressurized by the pump body 1, and is sent to the common rail 53 from the fuel delivery outlet. An injector 54 and pressure sensor 56 are mounted on the common rail 53. The injector 54 is mounted in the number corresponding to the number of engine cylinders, and performs injection in response to the signal sent from the controller 55.

The following describes the operation of the high pressure fuel pump 101 according to the aforementioned configuration:

A lifter 3 provided on the bottom end of the plunger 2 is pressure-welded with a cam 100 by a spring 4. The plunger 2 makes a reciprocal movement and changes the volume in the pressure chamber 12, using the cam 100 rotated by an engine cam shaft 72 or the like.

When the intake valve 5 is closed in the delivery stroke of the plunger 2, pressure in the pressure chamber 12 rises, and the delivery valve 6 automatically opens to feed fuel to the common rail 53.

The intake valve 5 automatically opens when the pressure of the pressure chamber 12 is reduced below that of the fuel inlet. However, closing of the valve is determined by the operation of the piezoelectric element.

When voltage is applied to the piezoelectric element 200 to turn it on, the piezoelectric element 200 is extended to the left in FIG. 1, and the large-diameter bellows 204 is pulled upward. The displacement of the large-diameter bellows 204 is converted into the displacement of the small diameter bellows 202 through the working fluid 208, and the displacement is magnified by the amount of the area ratio of both bellows. The engaging member 201 made integral with the small diameter bellows 202 is pulled toward the piezoelectric element 200, with the result that the engaging member 201 and intake valve 5 are separated from each other. Under this condition, the intake valve 5 acts as an automatic valve that is closed or opened in synchronism with the reciprocal movement of the plunger 2. Accordingly, the intake valve 5 is closed during the delivery stroke, and fuel in the amount corresponding to the reduced volume of the pressure chamber 12 pushes to open the delivery valve 6 to be fed to the common rail 53. Thus, the amount of the pump delivery becomes the maximum.

By contrast, when the piezoelectric element 200 is kept off, the intake valve 5 is kept open by the engaging member 201. Accordingly, even during the delivery stroke, the pressure of the pressure chamber 12 is kept at a low level almost the same as that of the fuel inlet. So the delivery valve 6 cannot be opened, and fuel in the amount corresponding to the reduced volume of the pressure chamber 12 is sent back to the fuel inlet through the intake valve 5. Thus, the amount of pump delivery can be reduced to zero.

Figure 3:
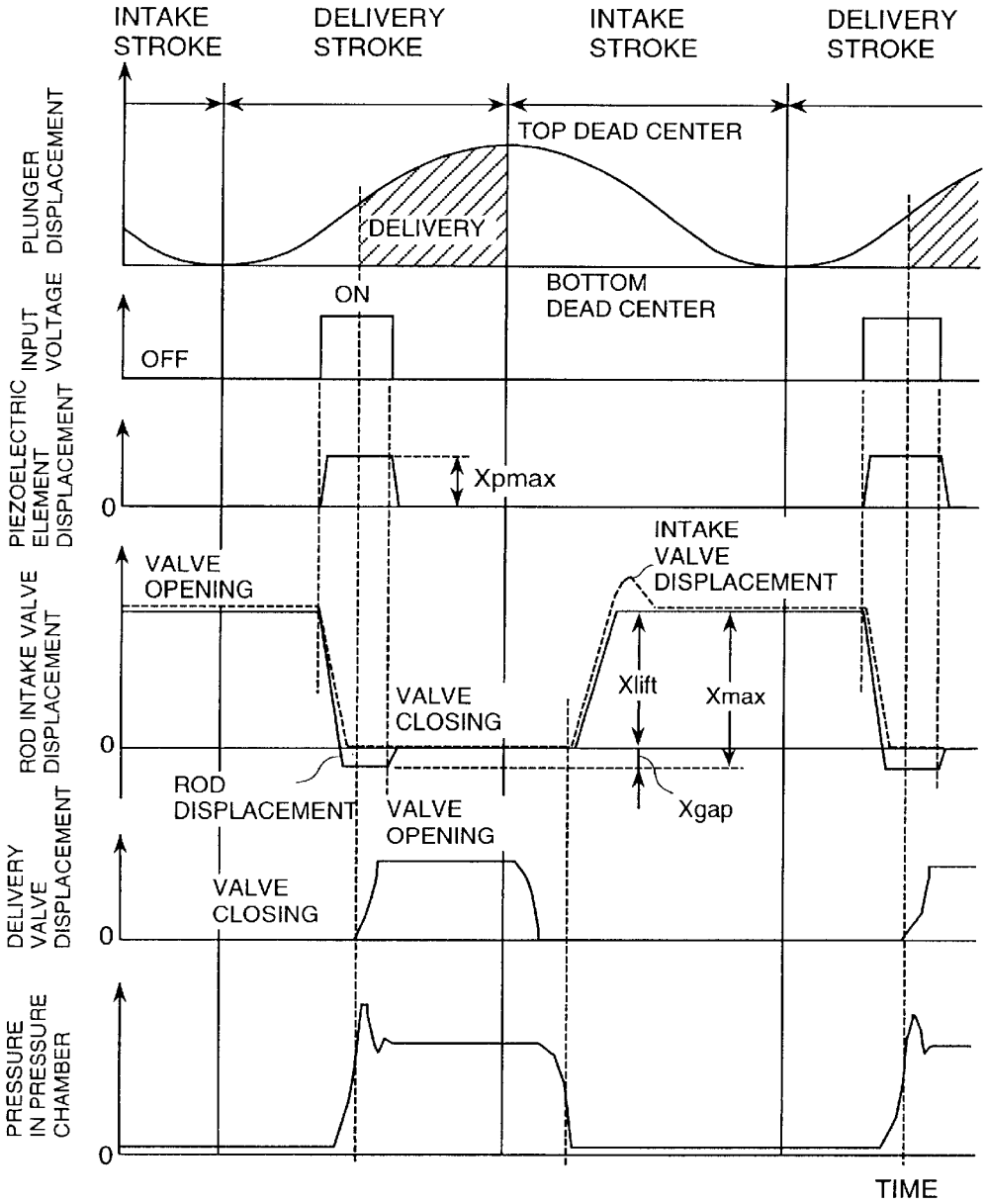
FIG. 3 is a drawing representing an example of the drive method for a high pressure fuel pump according to the present invention.

If the piezoelectric element 200 is turned on during the delivery stroke, fuel is fed to the common rail 53. Once fuel feed has started, the pressure in the pressure chamber 12 rises. So even if the piezoelectric element 200 is turned off after that, the intake valve 5 is kept closed, and is opened in synchronism with the start of the intake stroke. Accordingly, the amount of delivery can be adjusted in the range from 0 to 100% according to the time when the piezoelectric element 200 is turned on. FIG. 3 shows the time chart representing a series of operations, as will be described later.

Figure 2:
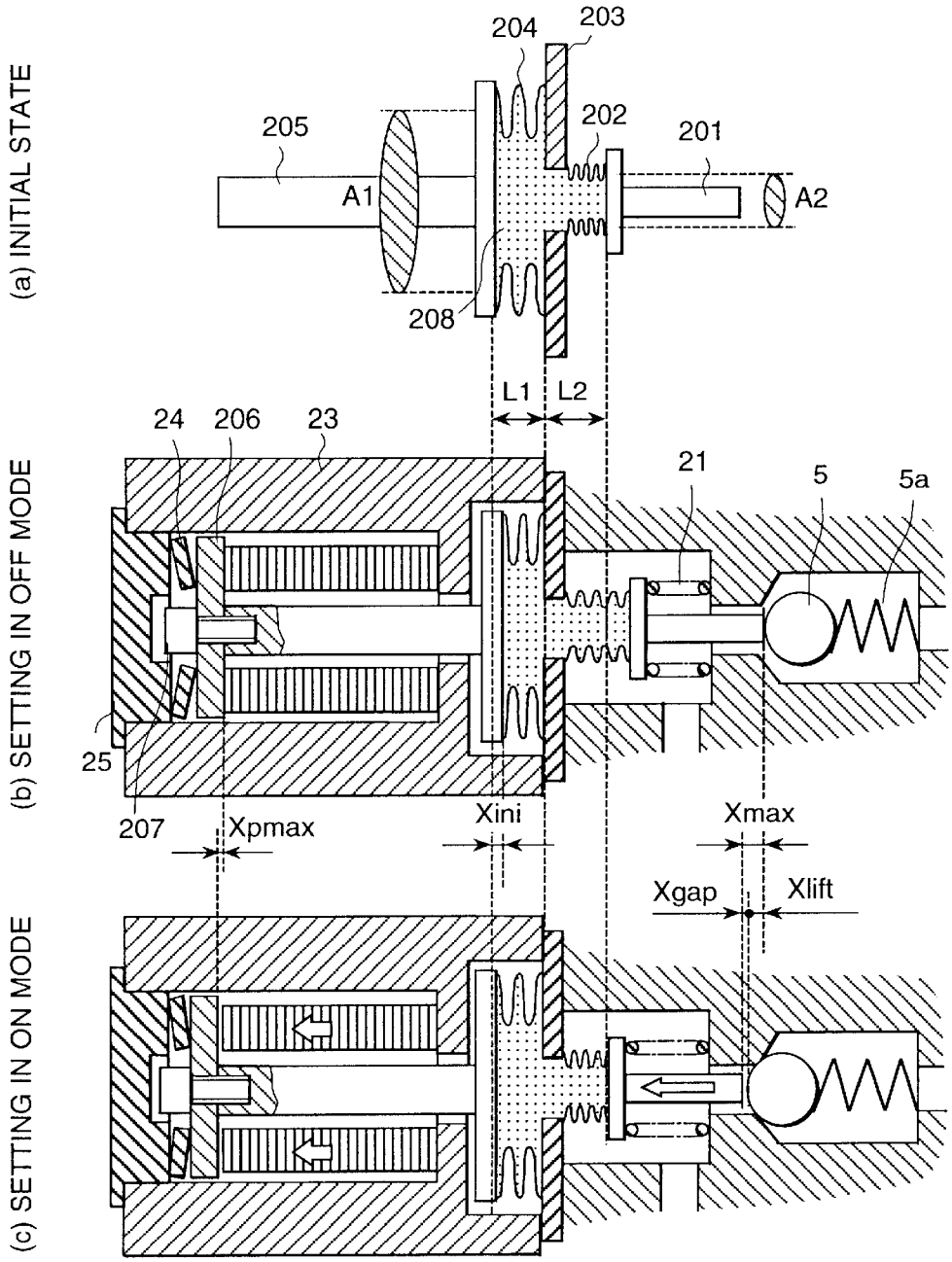
FIG. 2 is a detailed drawing representing the displacement magnifying mechanism of a high pressure fuel pump according to the present invention.

The following describes the details of the displacement magnifying mechanism with reference to FIG. 2. FIG. 2(*a*) exhibits the initial state hydraulic displacement magnifying mechanism alone. The state of free length is shown when the pressure of working fluid 208 is zero. The logical displacement magnification rate of this hydraulic displacement magnifying mechanism is given in terms of a ratio between the effective area A1 of the large-diameter bellows 204 and effective area A2 of small diameter bellows 202. The displacement of the piezoelectric element 200 can be magnified to A1/A2 times. A typical amount of piezoelectric element displacement is on the order of 20 microns for a length of 20 mm. It must be magnified to about ten through thirty times if it is to be used for the high pressure fuel pump. In order to improve the displacement magnifying efficiency and response as working fluid 208, the modulus of volume elasticity is preferred to be greater. For example, such oil includes hydraulic oil and brake oil.

FIG. 2(*b*) shows the displacement magnifying mechanism set in position. The large diameter bellows 204 is compressed and small diameter bellows 202 is extended in advance. In this state, the intake valve 5 is kept opened by "X lift" from the closed state As the "X lift" is increased, there is an increase in the opening area of the valve 5, resulting in a reduced loss in the pressure of fuel flowing backward through the intake valve 5 during the delivery stroke, and reduced energizing force given to the engaging member 201 by the intake valve 5. Namely, the intake valve 5 is kept open by small force. For example, if "X lift" is 0.4 mm, the maximum energizing force on the engaging member is about 20 N. The force acting on the piezoelectric element 200 is magnified A1/A2 times according to Pascal's principle. In the case of 20 magnifications of displacement, the force reaches 400 N. The force generated by the piezoelectric element 200 exceeds 3000 N even when the sectional area is about 1 square centimeter, allowing sufficient driving. Further, the piezoelectric element 200 itself is characterized by extremely high response. When reduction of response due to the hydraulic displacement magnifying mechanism is taken into account, high pressure driving well in excess of the prior art solenoid is ensured. The cam 100 used in the present embodiment is a triple cam permitting three reciprocations of the plunger 2 per rotation of the pump, in conformity to the 6-cylinder engine. Driving is also possible by a quadruple or quintuple cam in conformity to 8 cylinder or 10 cylinder engine.

FIG. 2(*c*) shows the configuration wherein the engaging member 201 is displaced by a maximum of "Xmax" when the piezoelectric element 200 is displaced by a maximum of "Xpmax", and gap "Xgap" is formed when the intake valve 5 is closed. This allows the intake valve 5 to be closed, and the amount of delivery to be variably adjusted. The gap "Xgap" varies according to the variation of the manufactured parts and thermal expansion. It is necessary to take this into account and to perform dimensional management to ensure that this gap will be formed.

If the intake valve 5 and engaging member 201 are made integral with each other, the large-diameter bellows 204 will be pulled up and raised further from where the intake valve is placed in the closed state when the piezoelectric element 200 is on. This increases the volume in the bellows and causes the problem of suddenly increasing the pressure of the working fluid 208. If the pressure is reduced below the saturated steam of the working fluid, vapor (bubble) is produced in the working liquid 208 to cause a substantial reduction in the apparent modulus of volume elasticity of the working fluid 208, with the result that the displacement magnifying rate and response will be reduced. To solve this problem, the high pressure fuel pump of the present invention is so configured that the intake valve 5 and engaging member 201 are separated from each other, thereby preventing vapor from occurring in working fluid.

Further, the initial compression "Xini" of the large-diameter bellows 204 is made greater than the maximum displacement "Xmax" of the piezoelectric element 200, and the large-diameter bellows 204 is always contracted, and the small-diameter bellows 202 always expanded during the use. This ensures the pressure of the working fluid 208 to be kept at the normal value at all times, thereby preventing vapor from occurring in working fluid. Further, when the bellows is less rigid, a sufficient is not applied to the working fluid 208, and pressure may not be increased. So the spring 21 is used to apply load to the small diameter bellows 202, thereby maintaining the positive pressure.

The piezoelectric element 200 is susceptible to thermal expansion because of slight displacement. When used in a car, particular care must be exercised due to a wide working temperature range. In addition to the thermal expansion of the piezoelectric element 200, the thermal expansion of the working fluid 208 cannot be ignored. A bigger value must be assigned to gap "Xgap" with consideration given to thermal expansion. Since "Xlift" is reduced by the corresponding amount, the displacement magnifying rate itself must be increased. This will increase the size of the bellows, and will reduce mountability on a car and response.

In the high pressure fuel pump of the present invention, the thermal expansion of a casing 23 is selected in such a way that the total thermal expansion of the piezoelectric element 200 and hydraulic displacement magnifying mechanism in the direction of displacement transfer is approximately the same as the thermal expansion of the casing 23. This allows the temperature change of the gap "Xgap" to be kept minimum and permits a big value to be assigned to the "Xlift" as an effective stroke by reducing "Xgap" itself. This provides the minimum displacement magnifying rate, with the result that natural frequency of the hydraulic displacement magnifying mechanism is increased and the response is improved. Thus, high pressure driving is ensured by making an effective use of the high-response characteristics of the piezoelectric element 200. As a result, the high speed fuel pump of the present invention can be mounted on a high speed engine and multi-cylinder engine—a feature that cannot have been realized by a prior art high pressure fuel pump.

FIG. 3 is a drawing representing an example of the drive method for a high pressure fuel pump according to the present invention. It shows the details of the operation having been described with reference to FIG. 1.

As described above, when the piezoelectric element is off, the engaging member (hereinafter abbreviated as "rod") keeps the intake valve open. When input voltage is applied to the piezoelectric element during the delivery stroke to turn it on, the piezoelectric element is displaced temporarily to produce displacement "Xpmax". The displacement of the piezoelectric element is magnified by the hydraulic displacement magnifying mechanism, and the rod is pulled toward the piezoelectric element. At the same time, the intake valve is also closed. From this instant, the pressure of the pressure chamber shown in the bottom stage starts to rise. When the pressure on the side of the delivery flow path has been exceeded, the delivery valve opens to start delivery. Once the pressure of the pressure chamber has risen, the valve is kept closed even if the piezoelectric element is turned off since the intake valve is kept down by liquid pressure much higher than the rod. The valve opens automatically in synchronism with the reduction of pressure in the pressure chamber after intake stroke has started.

When the valve is open, the intake valve is pushed up by the rod, there is a smaller loss of pressure before and after the intake valve required for valve opening than the loss of pressure in the case of the intake valve alone. This means that the intake performance has been improved. This allows the valve to be opened at a lower intake pressure, and permits the delivery pressure of the low pressure pump to be reduced, thereby contributing to energy saving. Since pressure reduction is small, fuel intake is enabled without vapor being produced when temperature is high. A high degree of pumping performance can be maintained over a wide working range.

In the method illustrated in FIG. 3, the piezoelectric element is turned off immediately after the rise of pressure in the pressure chamber. In this state, the rod to be displaced to "Xlift" is kept at "0" although the intake valve is kept closed. So the volume inside the bellows is reduced by the amount corresponding to the effective area A2×Xlift of the small-diameter bellows. Namely, the working fluid is compressed by this amount, and the pressure is increased. In some cases, the pressure of several MPa is generated inside the bellows. This pressure endangers durability, depending on the thickness of the bellows plate.

Figure 4:
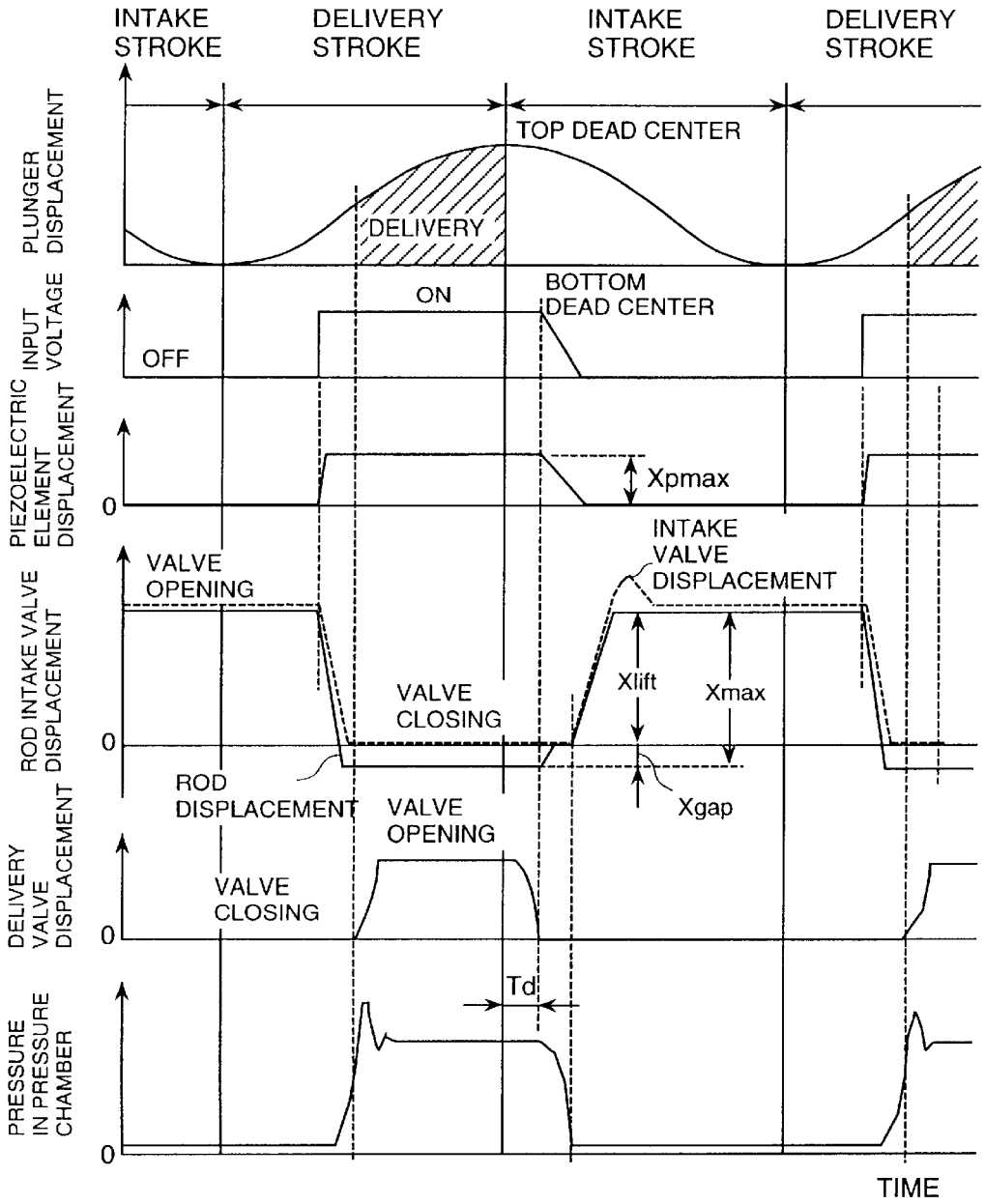
FIG. 4 is a drawing representing another example of the drive method for a high pressure fuel pump according to the present invention.

According to one example of the drive methods shown in FIG. 4, the piezoelectric element is kept on when the pressure of the pressure chamber is high. After the plunger starts intake stoke and the pressure in the pressure chamber starts to reduce, input voltage is lowered, whereby the rise of the aforementioned working fluid pressure is avoided. In this case, however, the rod is made to contact the intake valve by the time the intake valve starts to open, thereby assisting the intake valve to open. This improves the pump intake performance, similarly to the drive method shown in FIG. 3. When the rod is made to contact the intake valve, it is preferred that the input voltage be gradually lowered to avoid abrupt collision between the two, as shown in FIG. 4. It should be noted that the pressure in the pressure chamber starts to reduce after the delivery valve has closed. Since the time (Td) between start of the intake stroke and closing of the delivery valve is approximately constant, this drive method can be realized easily if Td is stored in a controller in advance.

Figure 5:
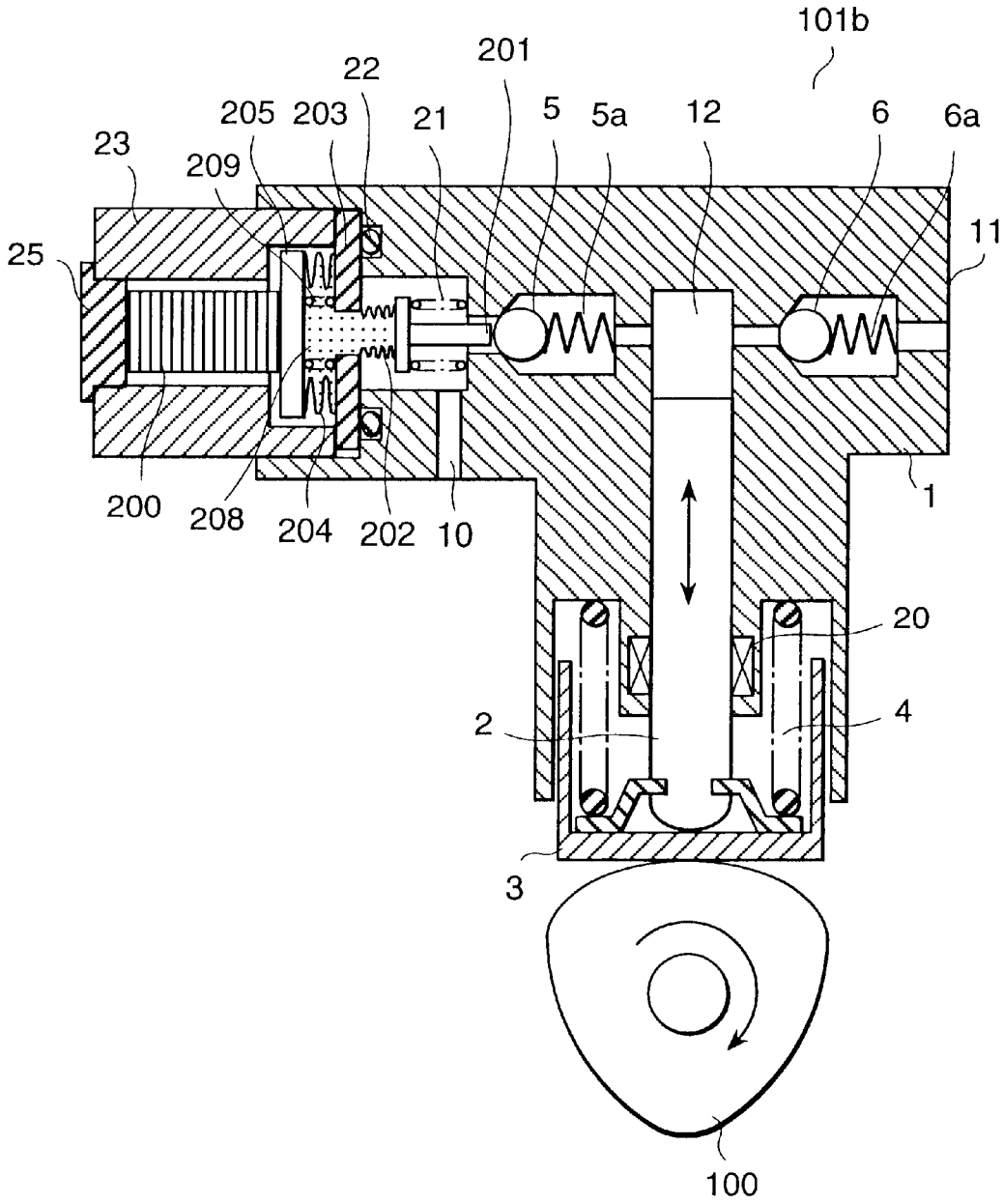
FIG. 5 is a vertical cross sectional view representing a high pressure fuel pump as another embodiment of the present invention.

FIG. 5 is a drawing representing another embodiment of the high pressure fuel pump according to the present invention. When the direction where the piezoelectric element 200 extends is reversed and the piezoelectric element 200 is off, the intake valve 5 and engaging member 201 are separated, making it possible to close the intake valve 5. If the piezoelectric element 200 is turned on, the engaging member 201 pushes open the intake valve 5. The on-off relationship is completely reserved to that in the embodiment of FIG. 1. Another big difference is that a spring 209 is arranged in the large-diameter bellows 204 in place of a belleville spring. This allows the end face of the large-diameter bellows 204 and the piezoelectric element 200 to be held under pressure. When the large-diameter bellows 204 itself is capable of generating a sufficient force as a spring, the spring 209 is not necessary.

Figure 6:
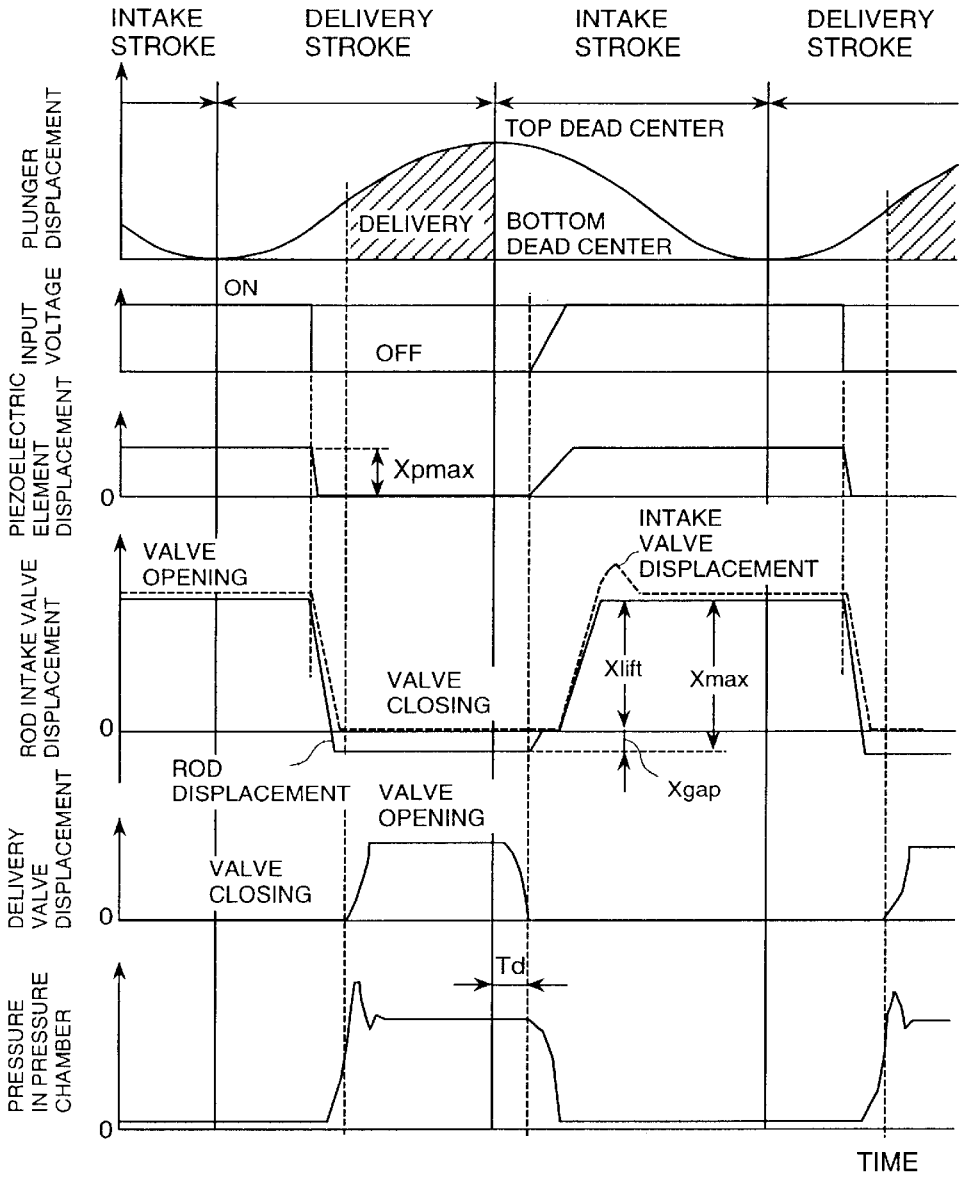
FIG. 6 is a drawing representing a further example of the drive method for a high pressure fuel pump according to the present invention.

FIG. 6 is a drawing representing the drive method for using the high pressure fuel pump as an example of the embodiment shown in FIG. 5. The only difference from the drive method of FIG. 4 described above is that the on/off relationship of the input voltage and the positional relationship of the piezoelectric element are reversed. There is no other difference. In this case, the amount of delivery can be variably controlled by changing the time of turning off. Further, after the intake stroke has started, input voltage is applied to the piezoelectric element before the closing of the intake valve and the rod is pressed against the intake valve. Then the pump intake performance is improved, similarly to the case of the previous embodiment.

As described above, the present invention makes an effective use of the large power and high response of the piezoelectric element to avoid automatic closing of the intake valve even in the case of a high-volume pump, and to control the amount of delivery up to a high speed. Moreover, it permits high pressure driving to provide a substantially high frequency of plunger reciprocation. In other words, the present invention provides a variable delivery type high pressure fuel pump characterized by a large flow rate and high pressure operation. Namely, it provides a high volume pump for high displacement engine and high-response pump for a high speed and multi-cylinder engine for use in a car.

The actuator is not restricted to a piezoelectric element. The same effect can be obtained when it uses an electrostrictive element or magnetostrictive element characterized by large power, high response and small displacement on the same level as those of the piezoelectric element.

The hydraulic displacement magnifying mechanism can use a diaphragm or piston without being restricted to bellows. However, the diaphragm cannot easily provide a sufficient stroke. The piston requires some measures to be taken against leakage of working fluid from the piston slideway. In this sense, the bellows are best suited.

The present invention provides a variable delivery control mechanism capable of controlling the amount of delivery up to a high rotational speed and allowing high-speed delivery control even when a high volume pump is used. Namely, the present invention provides a variable delivery type high pressure fuel pump that can be mounted on a high displacement engine, a high-speed engine or a multi-cylinder engine.

Figure 7:
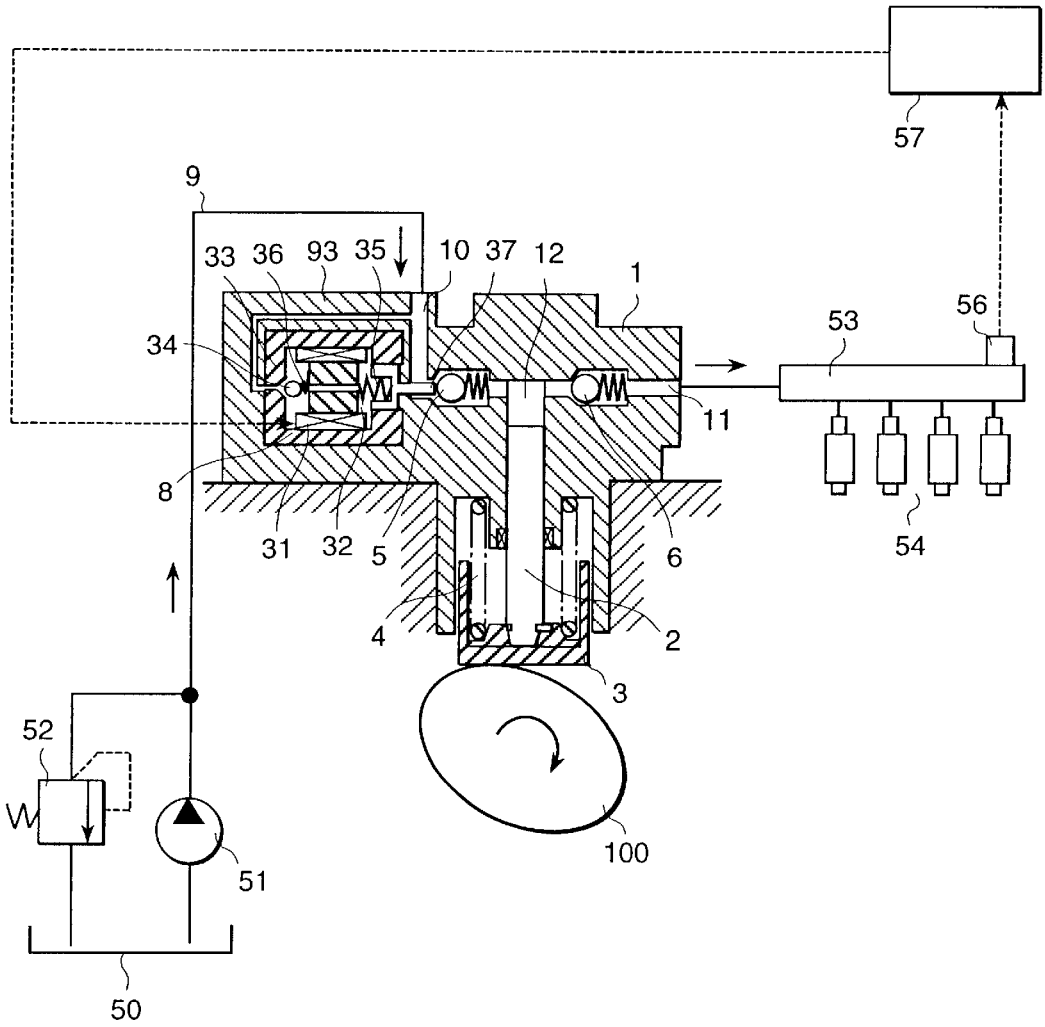
FIG. 7 is a system drawing representing an example of the high pressure fuel pump as an embodiment of the present invention.

Furthermore, the following describes another embodiments of the present invention:

First, the following explains the configuration of the fuel supply system using a high pressure fuel pump according to the present embodiment, with reference to FIG. 7.

A fuel intake passage 10, a delivery passage 11 and 1 pressure chamber 12 are formed in the pump body 1. A plunger 2 as a pressure member is slidably held in the pressure chamber 12. An intake valve 5 and a delivery valve 6 are arranged in the intake passage 10 and delivery passage 11, and each of them is held in one direction by a spring to serve as a check valve that restricts the direction of fuel flow. As will be shown in details in FIG. 8, the actuator 8 is held by the pump body 1, and rod 37 is operated by the drive signal coming from the controller 57 to be engaged or disengaged from the intake valve 5. When no drive signal is applied to the actuator 8, the intake valve 5 is kept open, as shown in FIG. 7. Further, a control valve 34 is held in one direction by a spring 36. It serves as a check valve that allows the fuel to flow only into the control chamber 32 when no drive signal is applied to the actuator 8.

The fuel is led to the fuel inlet of the pump body 1 from a tank 50 by a low pressure pump 51 after the pressure has been regulated to a predetermined level by a pressure regulator 52. Then pressure is applied by the pump body 1, and fuel is pump from the fuel delivery to the common rail 53. An injector 54 and pressure sensor 56 are mounted on the common rail 53. Injectors 54 are mounted in the number corresponding to that of the engine cylinders, and are used to inject the fuel according to the signal of the controller 57.

The plunger 2 is driven in reciprocal movement by a cam 100 rotated by an engine cam shaft or the like, to change the volume inside the pressure chamber 12.

If the intake valve 5 closes in the delivery stroke of plunger 2, pressure in the pressure chamber 12 is raised. This allows the delivery valve 6 to open automatically, with the result that fuel is pumped into the common rail 53.

The intake valve 5 opens automatically if the pressure in the pressure chamber 12 has been reduced below that at the fuel inlet, but closing of the valve is determined by the operation of the actuator 8. When a drive signal is given, the actuator 8 shown in details in FIG. 8 pulls a rod 37 to the side of a solenoid 31 to separate the rod 37 from the intake valve. Under this condition, the intake valve 5 serves as an automatic valve that opens and closes in synchronism with the reciprocal movement of the plunger 2. Accordingly, the intake valve 5 is closed in the delivery stroke and the fuel in the amount corresponding to the reduced volume of the pressure chamber 12 is pumped into the common rail 53 by pushing the delivery valve 6 open, whereby the maximum pump delivery flow rate is obtained.

By contrast, if no drive signal is applied to the actuator 8, the rod 37 will be engaged with the intake valve 5 to keep the intake valve 5 open. Accordingly, even in the delivery stroke, the pressure in the pressure chamber is kept at a low level almost the same as that of the fuel inlet. So the delivery valve 6 cannot be opened and the fuel in the amount corresponding to the reduced volume in the pressure chamber 12 is fed back to the fuel inlet through the intake valve 5, with the result that the pump delivery flow rate can be set to 0.

If a drive signal is applied to the actuator 8 in the middle of the delivery stroke, the actuator 8 pulls the rod 37 to the side of the solenoid 31 after the delay in response. Then the intake valve 5 is closed and pressure is applied to the fuel in the pressure chamber so that the fuel is pumped into the common rail 53. Once pumping has started, pressure in the pressure chamber 12 rises, so the intake valve 5 is kept closed even after the drive signal of the actuator 8 has been turned off. It closes automatically in synchronism with the start of the intake stroke. Accordingly, delivery can be adjusted in the range from 0 to the maximum amount of delivery in a certain delivery stroke, depending on the time interval of applying a drive signal to the actuator 8.

The proper time of delivery is calculated based on the signal of the pressure sensor 56 by the controller 57, and the rod 37 is controlled, whereby the pressure of the common rail 53 can be kept approximately at a predetermined value.

Figure 8A:
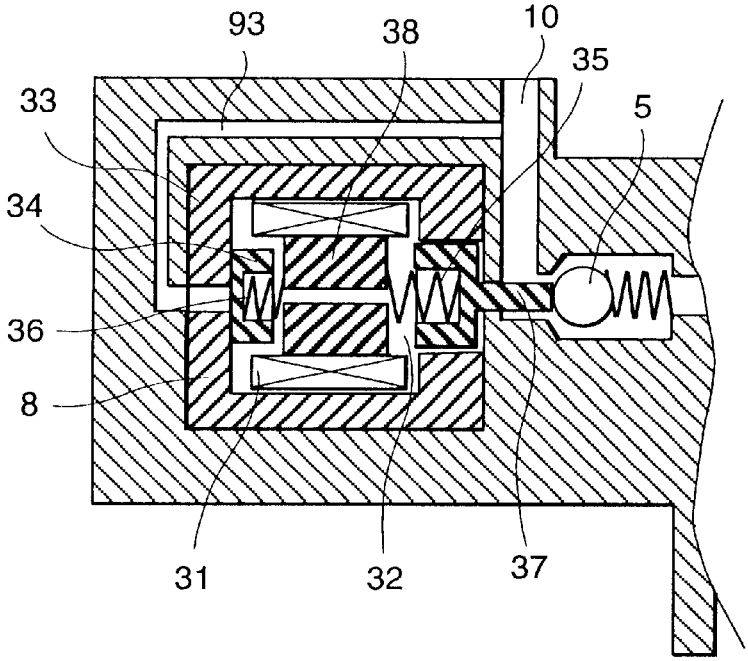
FIGS. 8A and 8B is a cross sectional view representing the actuator of the high pressure fuel pump according to the present invention.
Figure 8B:
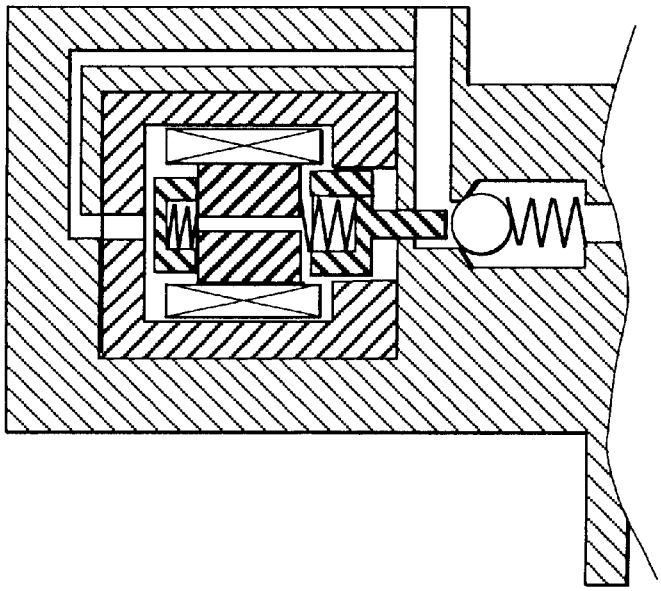

The following describes the configuration and operation of the actuator 8 with reference to FIGS. 8A and 8B. FIG. 8 is an enlarged cross sectional view representing the major portions around the actuator 8. The actuator 8 comprises a solenoid 31, a rod 37, a spring 35 for energizing the rod 37, a control valve 34, a spring 36 for energizing the control valve 34, a yoke 33 for covering the solenoid 31, a core 38 fixed inside the solenoid 31, and a control chamber 32, part of whose wall surface is formed with part of the rod 37 or a component operating in synchronism with the rod 37. The control chamber 32 contains a low-pressure flow path 93 leading to a fuel intake passage 10 via a control valve 34. Here the distance (air gap) between the control valve 34 and core 38 is smaller than the distance (air gap) between the rod 37 and core 38, and the stroke between the control valve 34 and core 38 is also smaller than that between the rod 37 and core 38. Since the rod 37 forms part of the wall surface of the control chamber 32, the volume of the control chamber 3 is changed when the rod 37 is displaced.

When no drive signal is applied to the actuator 8, the rod 37 and control valve 34 are energized in the direction of moving away from the core 38 by the energizing force of the spring 35 and 36 respectively, as shown in FIG. 8A. Since the control valve 34 is closed in this case, fuel in the control chamber 32 is enclosed, and there is no change in the volume of the control chamber 3. So the rod 37 is not displaced even if force in the reverse direction greater than the energizing force of the spring 35 is applied to the rod 38 from the outside. This condition is effective when the intake valve 5 is kept open by the rod 37 in the delivery stroke, namely when a small amount of fuel is to be delivered from the fuel pump. When the fuel pump is running at a high speed, a strong liquid pressure may be applied to the intake valve 5, and the rod 37 may be pushed with the force greater than the energizing force of the spring 35. Such a configuration allows flow control to be performed without the rod 37 being pushed back in the delivery stroke.

When a drive signal is applied to the actuator 8, the control valve 34 is attracted by electromagnetic force toward the core 38, as shown in FIG. 8B. This ensures a passage for the fuel to flow from the control chamber 32. When the electromagnetic force acting on the rod 37 has increased in excess of the energizing force of the spring 35, the rod 37 is attracted by the core 38. Fuel in the amount corresponding to the reduced volume in the control chamber 32 flows out into the low-pressure flow path 93 through the control valve 34 that is kept open. This operation makes it possible to close the aforementioned intake valve 5 that has been kept open, and to allow fuel to be delivered. The rod 37 is attracted at a desired time interval and the intake valve 5 is closed to control the amount of delivery. Here in order to ensure that the control valve 34 can be attracted earlier than the rod 37, it is possible to make the air gap of the control valve 34 shorter than that of the rod 37 so that the working electromagnetic force will be increased. Alternatively, it is possible to make the energizing force of the spring 36 smaller than that of the spring 35.

The following describes the behavior when the drive signal of the actuator is turned off: Electromagnetic force is reduced, and the control valve 34 and rod 37 make an attempt to be separated from the core 38 by the energized spring force. If the rod 37 is separated from the core 38, the volume of the control chamber 32 increases, so the fuel in the amount corresponding to the increased volume flows in through the control valve 34. When electromagnetic force is not applied, the control valve 34 acts as a check valve. It opens freely in the direction where fuel flows into the control chamber 3.

Actually, even if the control valve 34 is closed, there is leakage of fuel through the clearance of the movable portion of the rod 37 and control valve 34. It is difficult to ensure a perfect sealing of the control chamber 32. When the intake valve 5 is kept open, the rod 37 is pushed back in the direction of closing the valve in proportion to the amount of leakage if the fuel leaks from the control chamber 32. However, the maximum length of time when the rod 37 holds the intake valve 5 open is equivalent to the duration of the delivery stroke. In the case of a high pressure fuel pump where steps of intake and delivery are repeated at a high pressure, there is no functional problem if the fuel leakage can be kept in such a way that there is no fuel leakage in a half cycle type.

Figure 9:
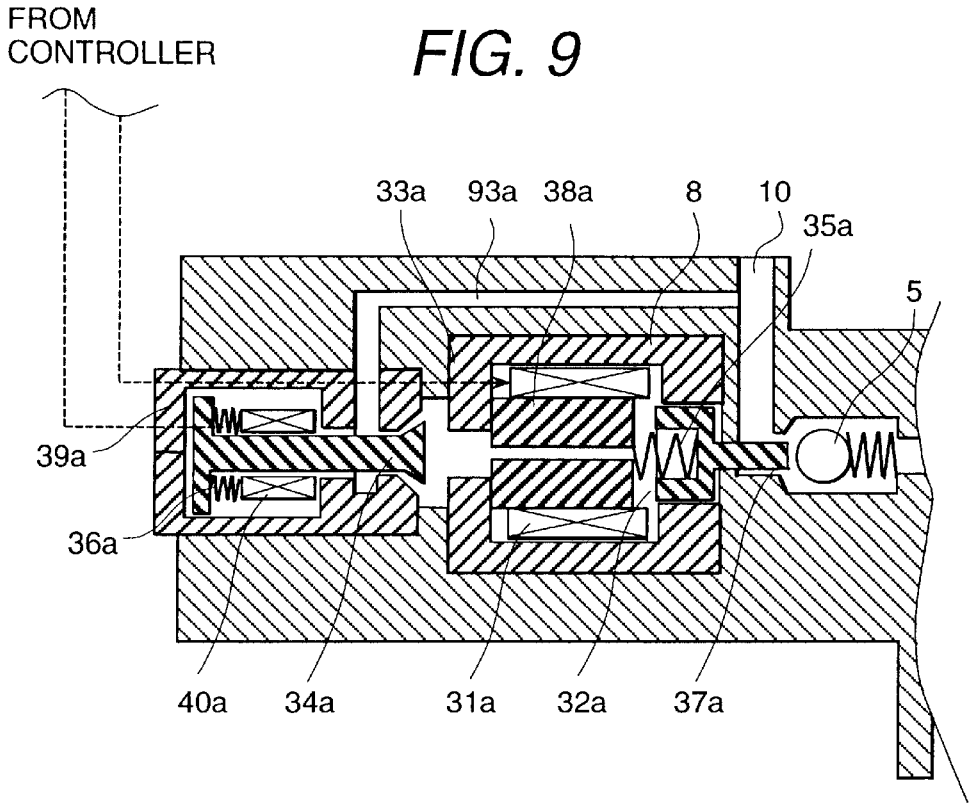
FIG. 9 is a partial drawing representing another example of the high pressure fuel pump as an embodiment of the present invention.

FIG. 9 shows an example of the actuator of the fuel pump described in claim 4. The difference with the aforementioned actuator is that a separate solenoid is arranged for each of the rod and control valve.

The volume of the control chamber 32*a* is changed in conformity to the displacement of the rod 37*a,* and flowing of the fuel into or out of the control chamber 32*a* is controlled by the control valve 39*a*. The control valve 39*a* is energized in the direction where the valve body 34*a* is closed by the spring 36*a*. When no drive signal is transmitted, it acts as a check valve. It allows liquid to flow from the low pressure flow path 93*a* to the control chamber 32*a,* but does not allow it to flow in the reverse direction. When the drive signal is sent, the solenoid 39*a* generates electromagnetic force to open the valve body 34*a*. Such a configuration provides the same effect as that of the aforementioned actuator. Namely, when the intake valve 5 is to be kept open in the delivery stroke, both of the solenoids are not provided with drive signal in order to hold the rod 37*a*. The rod 37*a* is energized by the energizing force of the spring 35*a* in such a direction that is moved away from the core 38*a*. The control valve 39*a* is used as a check valve so that the fuel inside the control chamber 32*a* is enclosed. Then the volume of the control chamber 32*a* does not change, so rod 37*a* is not displaced even if a reverse force stronger than the energizing force of the spring 35*a* is applied to the rod 37*a* from the outside. In this manner, the valve is kept open even if external force stronger than the energizing force of the spring 35*a* is applied to the intake valve in the delivery stroke. Drive signals are sent to both solenoids when the intake valve 5 in the opened state is to be closed in the delivery stroke. The control valve 34*a* is first opened to ensure the path for fuel outflow from the control chamber 32*a,* and the rod 37*a* is displaced. Then fuel displaced by the rod 37*a* passes through the control valve 34*a* in the open state to flow out to the low pressure flow path 93*a*. In this case, the control valve 34*a* is required to operate first. As illustrated in the first example, this is achieved by making the air gap of the control valve 34*a* shorter than that of the rod 37*a,* by making the energizing force of the spring 36*a* weaker than that of the spring 35, or by sending the drive signal of the control valve 34*a* earlier than that of the rod 37*a*. To get back to the original state in the last step, drive signals to both solenoids are stopped. This allows the energizing spring force to force the rod 37*a* to move away from the core 38*a* and the control vale 34*a* to close. Since the control chamber 32*a* expands, the fuel in the amount corresponding to the increased volume flows in through the control valve 34*a*. When the electromagnetic force is not applied, the control valve 34*a* acts as a check valve, so fuel flows freely in the direction of the control chamber 32*a*.

Figure 10:
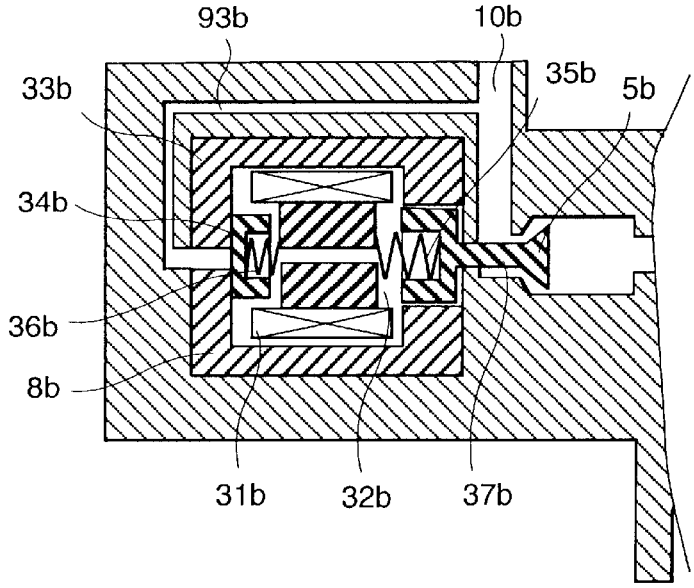
FIG. 10 is a partial drawing representing a further example of the high pressure fuel pump as an embodiment of the present invention.

FIG. 10 shows an example of the actuator of the fuel pump described in claim 7. The effects are basically the same as those of the fuel pump given in claim 3. A big difference is that the intake valve is integrally built with the rod. The volume of the control chamber 32*b* is changed in conformity to displacement of the valve body 37*b,* and flow of fuel into or out of the control chamber 32*b* is controlled by the control valve 34*b*. The control valve 34*b* is energized by the spring 36*b* in the direction of being closed, and acts as a check valve without drive signal being sent. Namely, fluid is allowed to pass from the low pressure flow path 93*b* to the control chamber 32*b,* but not the other way around. The intake valve 5*b* is energized by the energizing force of spring 35*b* in the direction of being opened. When the intake valve 5*b* is to be kept open in the delivery stroke, no drive signal is given to hold the rod 37*b*. The control valve 39*a* is used as a check valve to enclose the fuel in the control chamber 32*a*. This prevents the valve 5*b* from closing even if the intake valve 5*b* is exposed to external force for closing it stronger than the energizing force of the spring 35*b*. Further, a drive signal is sent to the actuator 8*b* when the intake valve 5*b* in the opened state is to be closed in the delivery stroke. The control valve 34*b* is first opened to ensure the path for fuel outflow from the control chamber 32*b,* and the rod 37*b* is then displaced. In this case, the control valve 34*b* must operate earlier than the rod 37*b*. The reliable method for achieving this has already been described in the previous Embodiment. Lastly, to get back to the original state, the drive signal is stopped. This allows energizing spring force to force the rod 37*b* to move away from the core 38*b,* and the control valve 34*b* to close. Since the volume of the control chamber 32*b* is increased, fuel in the amount corresponding to the increased volume flows in through the control valve 34*b*. When the electromagnetic force is not working, the control valve 34*b* acts as a check valve, so fuel freely flows into the control chamber 32*b*.

As described above, the present invention amplifies the energizing force of the engaging member without increasing the driving force of the actuator as a variable delivery mechanism, allows a high pressure fuel pump to be controlled in high pressure rotation, and permits the maximum flow rate to be increased.

For an actual car, the present invention provides means for controlling and supplying the required amount of fuel in the high speed range of an engine. Even when the number of pump reciprocations has been increased by increasing the pump displacement volume or the number of cams in order to increase the maximum amount of fuel supply, it enables variable delivery control with increasing the actuator driving force. A sufficient amount of fuel can be supplied to an engine of heavy displacement and fuel consumption and turbocharged engine.

It is also effective in ensuring a compact solenoid configuration and reduced noise and power consumption, without having to raise the actuator driving force.

The present invention provides a method for amplifying the energizing force of an engaging member without increasing the driving force of an actuator as a variable delivery mechanism, allowing a high pressure fuel pump to be controlled in high pressure rotation, and permitting the maximum flow rate to be increased.

What is claimed is:

1. A variable delivery type high pressure fuel pump comprising:

a pressure chamber leading to a fuel intake passage and a delivery passage;

a plunger that makes a reciprocating motion in said pressure chamber;

an intake valve inserted in said intake passage;

a delivery valve inserted in said delivery passage; and an engaging member driven by said actuator so as to give an energizing force to said intake valve; wherein the time interval of opening and closing said intake valve is controlled by an actuator operated by external force;

said high pressure fuel pump characterized by further comprising a hydraulic pressure mechanism for holding said intake valve opened via said engaging member when there is no input to said actuator.

2. A variable delivery type high pressure fuel pump according to claim 1:

said high pressure fuel pump characterized by further comprising a hydraulic displacement magnifying mechanism for magnifying said actuator displacement; wherein said hydraulic displacement magnifying mechanism gives energizing force to said intake valve.

3. A high pressure fuel pump according to claim 2: characterized in that said pump comprises a casing for storing said actuator and said hydraulic displacement magnifying mechanism; and the thermal expansion of said casing is selected in such a way that the total thermal expansion of said actuator and said hydraulic displacement magnifying mechanism in the direction of displacement transfer is approximately the same as the thermal expansion of said casing.

4. A high pressure fuel pump according to claim 2: characterized in that said hydraulic displacement magnifying mechanism is configured to convert a small displacement of a large-diameter bellows into a large displacement of a small diameter bellows through working fluid enclosed in bellows; and said large-diameter bellows is used at all times in the state compressed in the direction of displacement transfer with respect to the state of free length under no-load conditions in order to ensure that the pressure of said working fluid works at a positive value maintained at all times.

5. A high pressure fuel pump according to claim 4: characterized in that said actuator is made of a piezoelectric element, electrostrictive element or magnetostrictive element;

said engaging member is configured to push open said intake valve if there is no input to said actuator; and upon entry of an input to said actuator, said actuator pulls the large-diameter bellows to pull in the engaging member that displaces integrally with said small diameter bellows, and releases engagement with said intake valve so that said intake valve can be closed.

6. A high pressure fuel pump according to claim 5: characterized by input voltage control method in such a way that after the input voltage given to said actuator has been turned on, said actuator is kept turned on while the pressure in said pressure chamber remains as high as the pressure on the downstream side of said delivery passage; and, after said plunger has started intake stroke and the pressure in said pressure chamber has started to decrease, input voltage is reduced to move said engaging member close to said intake valve, and said engaging member is engaged with said intake valve by the time said intake valve starts to open, whereby said intake valve is energized in the direction of opening the valve.

7. A high pressure fuel pump according to claim 1:

said high pressure fuel pump characterized by further comprising a control chamber whose volume is increased or decreased by displacement of said engaging member, and a control valve for connecting or disconnecting between said control chamber and said intake passage;

wherein said control valve is opened in the delivery stroke before said engaging member actuates.

8. A high pressure fuel pump according to claim 7 characterized in that said actuator generates energizing force through electromagnetic force, and said engaging member and said control valve are driven by one and the same actuator.

9. A high pressure fuel pump according to claim 8 characterized in that the stroke of said control valve is shorter than that of said engaging member.

10. A high pressure fuel pump according to claim 1 characterized in that actuators for driving said control valve and said engaging member are provided, and said control valve is configured to provide faster response than said engaging member.

* * * * *